US005404072A

United States Patent [19]

Flanary et al.

[11] Patent Number: 5,404,072

[45] Date of Patent: Apr. 4, 1995

[54] UNISTRUCTURAL HOUSING FOR AN IMAGE INTENSIFIER TUBE

[75] Inventors: Jimmy M. Flanary; Peter L. Toch, both of Roanoke, Va.

[73] Assignee: ITT Corporation, New York, N.Y.

[21] Appl. No.: 69,995

[22] Filed: May 28, 1993

[51] Int. Cl.[6] ..... H01J 31/50

[52] U.S. Cl. ..... 313/477 R; 313/524

[58] Field of Search ..... 313/524; 359/350; 250/214 LA, 214 VT

[56] References Cited

U.S. PATENT DOCUMENTS

| | | | |
|---|---|---|---|
| 4,680,461 | 7/1987 | Boit et al. | 250/213 VT |
| 4,724,357 | 2/1988 | Drinkwine | 313/524 |
| 5,023,511 | 6/1991 | Phillips | 313/524 |
| 5,084,780 | 1/1992 | Phillips | 359/350 |
| 5,233,183 | 8/1993 | Field | 250/214 VT |

*Primary Examiner*—Stephen Brinich

*Attorney, Agent, or Firm*—Arthur L. Plevy; Patrick M. Hogan

[57] ABSTRACT

The present invention is a vacuum housing for an image intensifier tube, wherein the vacuum housing is unistructurally formed from a dielectric material and retains a photocathode, microchannel plate (MCP) and anode within an evacuated environment. The vacuum housing is manufactured as a single, solid component, thereby having no seams which may leak and compromise the evacuated environment. The various electrically operative elements of the photocathode, MCP and anode engage separate metalized surfaces formed within the vacuum housing. The electrically operative elements of the photocathode, MCP and anode within the vacuum housing are empowered by coupling the various metalized regions to sources of electrical potential external for the evacuated environment.

15 Claims, 3 Drawing Sheets

UNISTRUCTURAL HOUSING FOR AN IMAGE INTENSIFIER TUBE

FIELD OF THE INVENTION

The present invention relates to a vacuum housing structure for an image intensifier tube, of the type used in night vision equipment, and more specifically to such image intensifier housing structures that are unistructurally formed of a dielectric material.

BACKGROUND OF THE INVENTION

Image intensifier devices multiply the amount of incident light they receive and provide an increase in light output, which can be supplied either to a camera or directly to the eyes of a viewer. These devices are particularly useful for providing images from dark regions and have both industrial and military applications. For example, image intensifier tubes are used for enhancing the night vision of aviators, for photographing astronomical bodies and for providing night vision to sufferers of retinitis pigmentosa (night blindness). Such an image intensifier device is exemplified by U.S. Pat. No. 5,084,780, entitled TELESCOPIC SIGHT FOR DAY/NIGHT VIEWING by Earle N. Phillips issued on Jan. 28, 1992 and assigned to ITT Corporation the assignee herein.

Modern image intensifier tubes include three main components, namely a photocathode, a phosphor screen (anode) and a microchannel plate (MCP), disposed between the photocathode and anode. All three components are formed within an evacuated housing thereby permitting electrons to flow from the photocathode, through the MCP and to the anode. In order for the image intensifier tube to operate, the photocathode and anode must be coupled to an electric source whereby the anode is maintained at a higher positive potential than is the photocathode. Similarly, the microchannel plate must be empowered to increase the density of the electron emission set forth by the photocathode. Furthermore, since the photocathode, MCP and anode are all held at different electrical potentials, all three components must be electrically isolated from one another when retained within the vacuum housing.

In some prior art image intensifier tubes, the vacuum housing of the tube is constructed by the juxtaposition of conductive elements and dielectric elements. When assembled, the photocathode, MCP and anode engage the conductive elements within the vacuum housing. As such, an electric potential can be supplied to the photocathode, MCP and anode within the vacuum housing through the material of the vacuum housing itself. The dielectric elements juxtaposed between the conductive elements, isolates the photocathode, MCP and anode from one another, while the assemblage of the conductive and dielectric elements create the overall evacuated chamber of the image intensifier tube. Since the vacuum housings of such prior art image intensifier tubes are formed of both conductive and dielectric elements, the prior art housings can not be manufactured from a single material. Rather, the conductive elements and dielectric elements of such prior art vacuum housings must be formed separately and later joined to form the needed structure. Such prior art image intensifier tube housings therefore require multiple manufacturing tools and procedures to form and assemble the various conductive and dielectric elements. Furthermore, the various conductive and dielectric elements must be joined in an air tight manner so as to form the needed vacuum integrity. The complex manufacturing process and assembly procedure needed to produce such prior art vacuum housings add significantly to the cost at which such prior art image intensifier tubes can be manufactured. Additionally, since multiple joints exist between the various conductive and dielectric housing elements, there exist many points at which a vacuum leak may occur. Consequently, forming image intensifier tube housings from several juxtaposed components reduces the overall reliability of the image intensifier tube.

In view of the prior art, there exists a need for an image intensifier tube that has a housing that is simple to manufacture, has a reliable vacuum integrity and electrically isolates the photocathode, MCP and anode from each other while allowing each to be coupled to a source of electrical potential outside of the assembled image intensifier tube.

SUMMARY OF THE INVENTION

The present invention is a vacuum homing for an image intensifier tube, wherein the vacuum housing is unistructurally formed from a dielectric material and retains a photocathode, microchannel plate (MCP) and anode within an evacuated environment. The vacuum housing is manufactured as a single, solid component, thereby having no seams which may leak and compromise the evacuated environment. The various electrically operative elements of the photocathode, MCP and anode engage separate metalized surfaces formed within the vacuum housing. Consequently, the electrically operative elements of the photocathode, MCP and anode within the vacuum housing may be empowered by coupling the various metalized regions to sources of electrical potential.

Metalized regions proximate the ends of the vacuum housing extend past the ends of the vacuum housing to the exterior surface of the vacuum housing. As such, the metalized region can be directly coupled to a source of electrical potential external of the vacuum housing. Electrical interconnections to metalized surfaces, that are isolated within the evacuated environment of the vacuum housing, are made via conductive pins which extend through the dielectric material of the vacuum housing. As such, a source of electrical potential can be joined to the conductive pins at a point external of the vacuum housing to provide an electrical bias to metalized surfaces within the vacuum housing.

The positions of the various conductive pins on the exterior of the vacuum housing are radially and laterally spaced to increase the distance between pins along the surface of the vacuum housing. Consequently, electrical leakage across the surface of the vacuum tube can be more readily controlled.

BRIEF DESCRIPTION OF THE DRAWINGS

For a better understanding of the present invention, reference is made to the following description of an exemplary embodiment thereof; considered in conjunction with the accompanying drawings, in which.

DETAILED DESCRIPTION OF THE INVENTION

Figure 1:
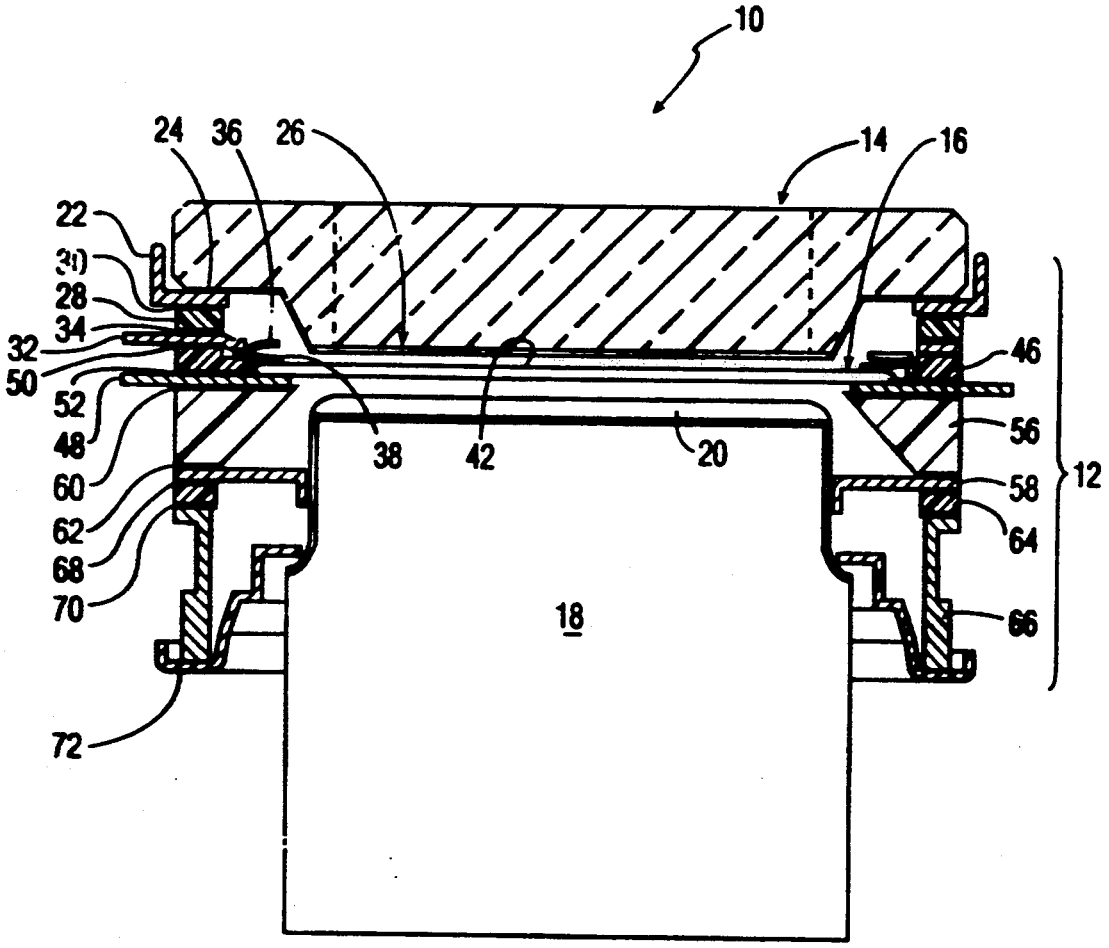
FIG. 1 PRIOR ART
FIG. 1 is a cross sectional view of a prior art image intensifier tube.

Referring to FIG. 1, there is shown a cross-sectional view of a conventional prior art Gen III image intensifier tube 10 of the type currently manufactured by ITT Corporation, Electro Optical Products Division of Roanoke, Va. The prior art Gen III image intensifier tube 10 includes a evacuated housing 12 made from the assemblage of several separate components. Within the housing 12 is positioned a photocathode 14, microchannel plate (MCP) 16, and an inverting fiber optic element 18, which supports a phosphor screen 20. The construction for the vacuum housing 12 includes eighteen separate elements stacked atop one another and joined so as to form an air tight envelope between the photocathode 14 and the fiber optic element 18.

The photocathode 14 rests upon a conductive support ring 22 at one end of the vacuum housing 12. The abutment of the photocathode 14 against the support ring 22 creates an air tight seal thereby closing one end of the vacuum housing 12. The support ring 22 contacts a metalized surface 24 on the face of the photocathode 14. The metalized surface 24, in turn, is coupled to a photoresponsive layer 26, on the photocathode 14 that is contained within the evacuated environment of the vacuum housing 12. As such, an electrical bias can be applied to the photoresponsive layer 26 of the photocathode 14 within the evacuated environment by applying the electrical bias to the support ring 22 on the exterior of the vacuum housing 12.

A first annular ceramic spacer 28 is positioned below the support ring 22. The first ceramic spacer 28 is joined to the support ring 22 by a first copper brazing ring 30 which is joined to both the first ceramic spacer 28 and the support ring 22 during a brazing operation. The brazing operation thereby creates an air impervious seal between the support ring 22 and first ceramic spacer 28. An upper MCP terminal 32 is joined to the first ceramic spacer 28, opposite support ring 22. The upper MCP terminal 32 is also joined to the first ceramic spacer 28 in a brazing operation, as such, a second brazing ring 34 is interposed between the upper MCP terminal 32 and the first ceramic spacer 28. The upper MCP terminal 32 extends into the vacuum housing 12 where it conductively engages a hold down ring 36 and a contact ting 38. The contact ring 38 engages the conductive upper surface 42 of the MCP 16. Consequently, an electrical bias can be applied to upper surface 42 of the MCP 16 by applying the electrical bias to the upper MCP terminal 32 on the exterior of the vacuum housing 12.

A second ceramic spacer 46 is positioned below the upper MCP terminal 32, isolating the upper MCP terminal 32 from a lower MCP terminal 48. The second ceramic spacer 46 is brazed to both the upper MCP terminal 32 and the lower MCP terminal 48, as such a second brazing ring 50 is interposed between the upper MCP terminal 32 and second ceramic spacer 46 and a third brazing ring 52 is interposed between the second ceramic spacer 46 and the lower MCP terminal 48. The lower MCP terminal 48 extends into the vacuum housing 12 and engages the lower conductive surface 44 of the MCP 16. As such, the lower conductive surface 44 of the MCP 16 can be coupled to ground by connected the lower MCP terminal 48 to a ground potential external of the vacuum housing 12.

A third ceramic spacer 56 separates the lower MCP terminal 48 from a getter shield 58. The third ceramic spacer is brazed to both the lower MCP terminal 48 and the getter shield 58. As such, a fifth brazing ring 60 is interposed between the lower MCP terminal 45 and the third ceramic spacer 56. Similarly, a sixth brazing ring 62 is interposed between the third ceramic spacer 56 and the getter shield 58.

A fourth ceramic spacer 64 is positioned below the getter shield 58, separating the getter shield from the output screen support 66. The fourth ceramic spacer is brazed to both the getter shield 58 and the output screen support {56, as such a seventh and eighth brazing ring 68 and 70 are positioned above and below the fourth ceramic spacer 64, respectively.

The lower end of the vacuum housing 12 is sealed by the presence of an output screen flange 72. The output screen flange 72 is joined to both the output screen support 66 and the fiber optic element 18. Consequently, an air tight envelope is defined by the vacuum housing 12 in between the photocathode 14 and the fiber optic element 18, whereby the vacuum housing 12 is constructed by numerous stacked components joined together in an air impervious manner.

In the prior art embodiment of FIG. 1, the photocathode support ring 22 and upper MCP terminal 32 are separated by the first ceramic spacer 28. The first ceramic spacer 28 is not large. As such, if large differences in potential are applied to the support ring 22 and the upper MCP terminal 32, arcing or other electrical leakage may occur across the first ceramic spacer 28 on the exterior of the vacuum housing 12. Similarly, if large varied potentials are applied between the upper MCP terminal 32 and lower MCP terminal 48, similar arching or other leakage may occur across the second ceramic spacer 46. Such leakage problems are particularly prevalent across the exterior of the vacuum housing 12 in humid environments.

Figure 2:
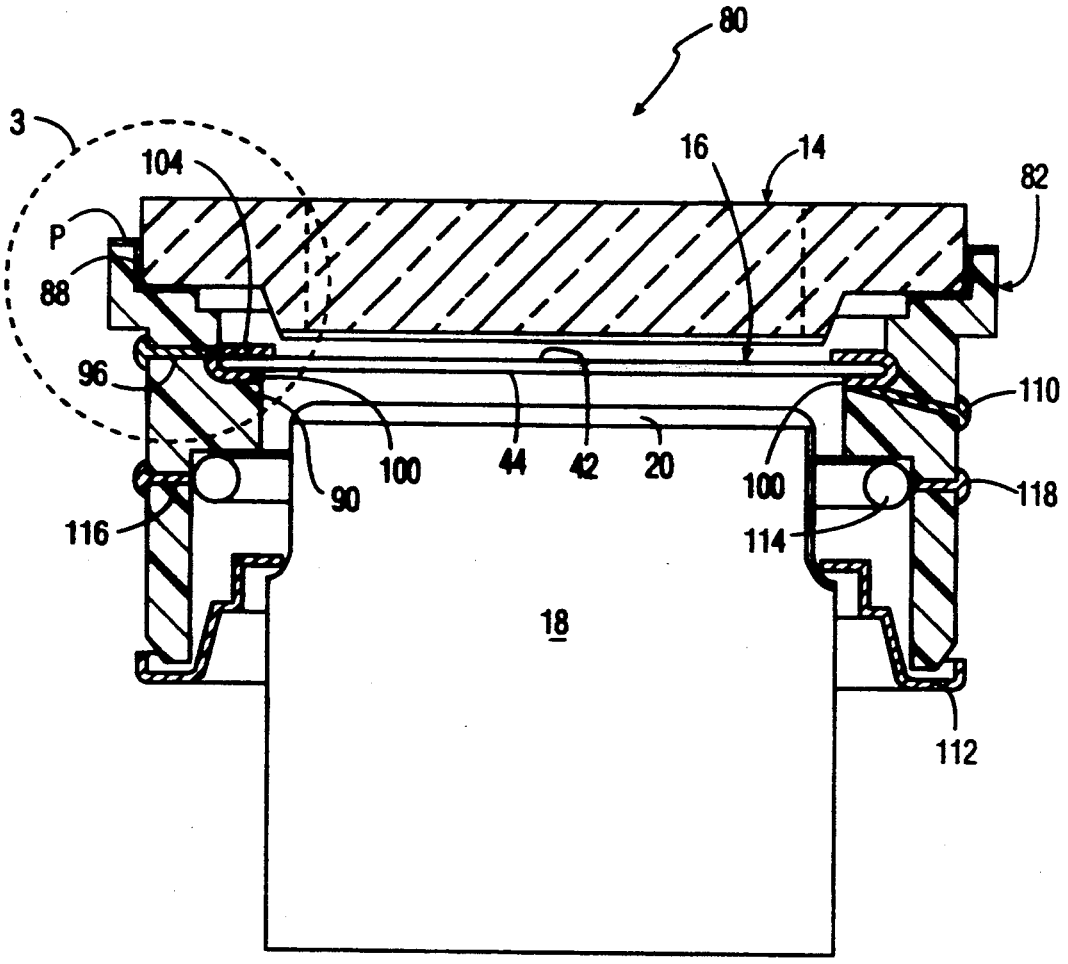
FIG. 2 is a cross sectional view of one preferred embodiment of the present invention image intensifier tube.

Referring now to FIG. 2, there is shown an image intensifier robe 80 embodying one preferred embodiment of the present invention vacuum housing 82. In the preferred embodiment, the vacuum housing 82 is unistructurally formed from a dielectric material, such as a ceramic, but may be any other equivalent dielectric such as plastic, glass or the like. The formation of the unistructural vacuum housing 82 may be made in an known manner appropriate for the materials being formed, but is preferably formed by powder metallurgy utilizing an aluminum oxide ceramic.

As with the prior art image intensifier tube housings, the present invention vacuum housing 82 is formed to retain a photocathode 14, a microchannel plate 16 and a phosphor screen 20, deposited on a fiber optic element 18. However, in the present invention vacuum housing 82, there are no seams between juxtaposed conductive and dielectric layers. As such, the present invention housing 82 is less likely to contain a vacuum leak as compared to the prior art embodiment of FIG. 1. With no seams to cause a vacuum leak, the unistructural construction of the present invention vacuum housing 80 is inherently more reliable than multi-component prior art housings. Additionally, by unistructurally constructing the vacuum housing 82 from a single dielectric material, the labor needed to assembly and join the multiple components of prior art image intensifier tubes is eliminated. As such, the present invention vacuum housing 82 can be manufactured in a less labor intensive and more time efficient manner.

Comparing the present invention vacuum housing 82 to the prior art vacuum housing 12 of FIG. 1, it can be seen that the overall geometry of both housing are essentially the same in that both housings are shaped to retain the same photocathode 14, MCP 16 and phosphor screen 20 in a predetermined spatial orientation. Since the present invention vacuum housing 82 is uniformally dielectric, the coupling of the photocathode 14, MCP 16 and phosphor screen 20 to sources of electrical potential outside the vacuum housing 82 can no longer be made directly through the material of the vacuum housing 82. Rather, an electrical coupling means is formed through the dielectric material of the vacuum housing 82 to provide the needed electrical interconnections.

Figure 3:
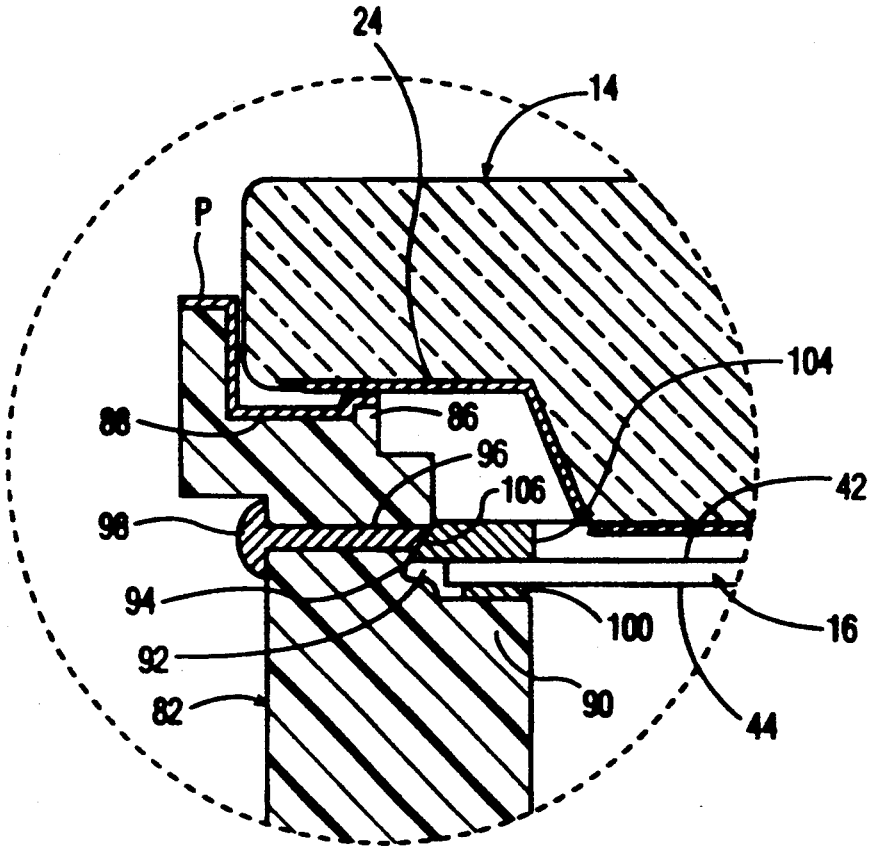
FIG. 3 an enlarged detailed view of the section of FIG. 2 found within circle 3.

Referring to FIG. 3 in conjunction with FIG. 2, it can be seen that when the photocathode 14 is assembled into the vacuum housing 82, the photocathode 14 engages a ledge 86 formed as pan of the vacuum housing 82. A layer of conductive material 88 is applied onto the dielectric vacuum housing 82 across the region of the ledge 86. The conductive layer 88 extends along the surface contours of the vacuum housing 82 from the ledge 86 inside the vacuum housing 82 to a point P on the exterior of the vacuum housing 82. The conductive layer 88 within the vacuum housing 82 engages the conductive coating 24 present across the face of the photocathode 14. As such, by applying a source of electrical potential to the conductive layer 88 at point P on the exterior of the vacuum housing 82, the photocathode 14 can be enabled within the vacuum housing 82. The conductive layer 88 can be formed on the dielectric material of the vacuum housing 82 utilizing any known metal deposition technique.

A second ledge structure 90 is formed within the vacuum housing 82. A recess 92 is formed adjacent to the second ledge structure 90 having a sloped face surface 94. A conductive pin 96 is disposed through the dielectric material of the housing 82 from a point on the sloped face surface 94 of the recess 92 to a point on the exterior of the vacuum housing 82. The conductive pin 96 can be made of any conductive metal and may be applied through the vacuum housing 82 in any known manner. For instance, the conductive pin 96 can be introduced through a hole machined in the vacuum housing 82 or the conductive pin 96 can be formed as pan of the vacuum housing 82 as the vacuum housing 82 is manufactured. On the exterior of the vacuum housing 82, the conductive pin 96 may terminate with an enlarged head 98 so as to facilitate ease of engagement with a source of electrical potential.

A second conductive layer 100 is formed within the vacuum housing 82 upon the second ledge structure 90. The second conductive layer 100 can be created upon the dielectric material of the vacuum housing 82 utilizing any known metal deposition technique. The MCP 16 rests upon the second conductive layer 100 within the vacuum housing 82. Consequently, the second conductive layer 100 contacts the conductive lower layer 44 of the MCP 16. A metal spring retention ring 104 is positioned above the MCP 16 within the vacuum housing 82. The spring retention ring 104 has a sloped outer surface 106 which engages the sloped face surface 94 of recess 92. The spring bias embodied by the spring retention ring 104 forces the sloped outer surface 106 of the spring retention ring 104 against the sloped face surface 94 of the recess 92. The slopes of spring retention ring 104 and the recess 92 causes the spring retention 104 to be biased against the conductive upper surface 42 of the MCP 16. Consequently, the conductive lower surface 44 of the MCP 16 is driven against the second conductive layer 100, present on the second ledge structure 90.

The engagement of the spring retention ring 104 within recess 92 causes the spring retention ring 104 to engage the conductive pin 96. As such, the presence of the spring retention ring 104 within recess 92 electrically interconnects the conductive pin 96 to the conductive upper surface 42 of the MCP 16. Consequently, an electrical potential can be applied to the upper surface 42 of the MCP 16, within the vacuum housing 82, by applying an electrical potential to the conductive pin 96 at a point on the exterior of the vacuum housing 82.

Referring to FIG. 2, it can be seen that a second conductive pin 110 is formed through the dielectric material of the vacuum housing 82. The second conductive pin 110 contacts the second conductive layer 100 formed on the second ledge structure 90. Since the second conductive layer 100 is coupled to the conductive lower surface 44 of the MCP 16, a ground potential can be applied to the conductive lower surface 44 of the MCP 16 by applying a ground potential to the second conductive pin 110.

An output screen flange 112 joins the bottom of the vacuum housing 82 to the fiber optic element 18, thereby completing the integrity of the evacuated environment in between the fiber optic element 18 and the photocathode 14. The output screen flange 112 joins with the dielectric vacuum homing 82 in an air impervious manner. The output screen screen flange 112 is electrically coupled to the phosphor screen 20 on the fiber optic element 18, in the same manner known and practiced in the prior art. As such, an electrical potential can be applied to the phosphor screen 20 within the vacuum housing 82 by applying the electric potential to the output screen flange 112 on the exterior of the vacuum housing 82. Additionally, a getter wire 114 is positioned within the vacuum housing 82. The getter wire 114 follows the interior of the vacuum housing 82, extending approximately 180 degrees from a first getter terminal pin 116 to an oppositely positioned second getter terminal pin 118. The first and second getter terminal pins 116, 118 are formed through the dielectric material of the vacuum housing 82 in the same manner as previously described in regard to the other conductive pins. The getter wire 114 is joined to both the first and second getter terminal pins 116, 118 with a brazing procedure, spot weld or the like. The first and second getter terminals pins 116, 118 allow the getter wire to be electrically engaged from outside the vacuum housing 82. Consequently, upon assembly of the image intensifier tube 80, the getter wire 114 can be fired by passing the appropriate current between the first and second getter terminal pins 116, 118. The getter wire 114 is positioned below a large overhang 120 formed with the vacuum housing 82. The overhang 120 protects the phosphor screen 20, MCP 16 and photocathode 14 during the firing of the getter 114. Consequently, the need for a getter shield, such as that found in the prior art of FIG. 1, is eliminated.

In the present invention image intensifier tube 80, the distance between the first conductive pin 96 and the second conductive pin 110 is greatly increased over that of the prior art embodiment of FIG. 1. As such, a much larger difference in potential can be applied between the first conductive pin 96 and the second conductive pin 110 without significant leakage across the surface of the vacuum housing 82. Similarly, the distance between the conductive layer 88, that enables the photocathode 14, and the first conductive pin 96 is also increased. This increased distance, in addition to the partial shielding of the first conductive pin 96, created by the contouring of the vacuum housing 82, acts to deter surface leakage from occurring between the conductive layer 88 and the first conductive pin 96, even in highly humid environments. Although the placement of the various conductive pins on the vacuum housing 82 appeared to be linear in FIG. 2, it should be understood that this orientation is demonstrative only. In the preferred embodiment, the various pins would be positioned at differing positions along the exterior of the vacuum housing 82 and the pins would not align. Rather, the radial dispersion of the pins would purposely space the pins apart from one another on the exterior of the housing. By radially spacing the various pins apart from one another, the distance along the surface of the vacuum housing 82 between various pins is maximized. Consequently, surface leakages of electrically are reduced, especially in humid environments.

It will be understood that the embodiment described herein is merely exemplary and that a person skilled in the an may make many variations and modifications to the described embodiment utilizing functionally equivalent elements to those described. More specifically, it should be understood that the vacuum housing 82 described can be formed of any dielectric material such as plastic or glass and need not be ceramic. Additionally, although the present was described in relation to a Gen III image intensifier tube, the present invention can be applied to any other electron tube. All such variations and modifications are intended to be included within the scope of this invention as defined by the appended claims.

What is claimed is:

1. In an image intensifier tube having electrically operative components that include a photocathode, having a photoemissive layer, and a microchannel plate having a conductive input surface and a conductive output surface, retained within an evacuated environment of a vacuum housing, an improved vacuum housing comprising a homogeneous unistructural construction of at least one dielectric material wherein said vacuum housing defines at least one aperture that extends from at least one point on an interior surface of said vacuum housing to at least one point on an exterior surface of said vacuum housing;

at least one metalized region disposed on said vacuum housing within said evacuated environment wherein said output surface of said microchannel plate engages a first metalized region within said evacuated environment, and coupling means extending through said at least one aperture for electrically coupling said electrically operative components to said at least one point on the exterior surface of said vacuum housing, wherein said coupling means couples said first metalized region to a first terminal point on the exterior surface of said vacuum housing.

2. The vacuum housing according to claim 1, wherein said coupling means includes at least one conductive element that extends through said at least one aperture in said vacuum housing.

3. The vacuum housing according to claim 1, further including a second metalized region within said vacuum housing, wherein said second metalized region extends out of said evacuated environment, thereby interconnecting at least one of said electrically operative components within said vacuum housing to a point on the exterior surface of said vacuum housing.

4. The vacuum housing according to claim 1, wherein said coupling means electrically couples said photoemissive layer to a second terminal point on the exterior surface of said vacuum housing and couples said conductive input surface to a third terminal point on the exterior of said vacuum housing.

5. The vacuum housing according to claim 4, wherein a conductive retaining means retains said output surface of said microchannel plate in contact with said first metalized region, said conductive retaining means conductively contacting said conductive upper surface of said microchannel plate, said conductive retaining means being electrically coupled to at least one conductive element that extends through said dielectric material of said vacuum housing, coupling said conductive input surface of said microchannel plate to said third terminal point via said conductive retaining means.

6. The vacuum housing according to claim 5, wherein said conductive retaining means biases said output surface of said microchannel plate against said first metalized region within said vacuum housing.

7. The vacuum housing according to claim 4, wherein said photocathode engages said vacuum housing in a second metalized region within said evacuated environment, said second metalized region of said vacuum housing extending out of said evacuated environment, joining said photoemissive layer to said second terminal point.

8. The vacuum housing according to claim 1, wherein said vacuum housing is part of a Gen III image intensifier tube.

9. The vacuum housing according to claim 7, wherein said dielectric material is a ceramic.

10. The vacuum housing according to claim 4, wherein said first terminal point and said third terminal point are radially spaced relative one another along the exterior of said vacuum housing.

11. An image intensifier tube comprising:

a photocathode for emitting electrons in response to electromagnetic radiation impinging upon said photocathode;

a microchannel plate for multiplying said electrons emitted by said photocathode, wherein said microchannel plate has a conductive input surface and a conductive output surface;

a phosphor screen for receiving said electrons emitted by said photocathode and converting said electrons into a visual image;

a homogenous unistructurally formed dielectric vacuum housing for retaining said photocathode, said microchannel plate and said phosphor screen in a predetermined arrangement within an evacuated environment, wherein said vacuum housing defines a plurality of apertures that extend from internal points within said evacuated environment of said vacuum housing to external points on the exterior of said vacuum housing;

at least one metalized region disposed on said vacuum housing within said evacuated environment, wherein said output surface of said microchannel plate electrically engages a first metalized region; and coupling means for coupling said at least one metalized region to terminals external of said evacuated environment.

12. The image intensifier tube according to claim 11, wherein said photocathode engages said vacuum housing in a second metalized region within said evacuated environment, said second metalized region extending out of said evacuated environment, joining said photoemissive layer to a terminal point on the exterior of the vacuum tube.

13. The image intensifier tube according to claim 11 further including a getter wire disposed within said evacuated environment wherein said vacuum housing shields said getter from said photocathode, said microchannel plate and said phosphor screen.

14. The image intensifier tube according to claim 11, wherein a conductive retaining means retains said output surface of said microchannel plate in contact with said first metalized region, said conductive retaining means conductively contacting said conductive input surface of said microchannel plate, said conductive retaining means being electrically coupled to at least one conductive element that extends through at least one of said apertures in said vacuum housing, coupling said conductive input surface to at least one of said terminals.

15. The image intensifier tube according to claim 11, wherein said vacuum housing is selected from a group consisting of ceramic, plastic and glass.

* * * * *